US010683686B2

(12) United States Patent
Brown et al.

(10) Patent No.: US 10,683,686 B2
(45) Date of Patent: Jun. 16, 2020

(54) WINDOW SECURITY DEVICE

(71) Applicant: LaserSeed Inc., Calgary OT (CA)

(72) Inventors: Kenneth M. Brown, Calgary (CA); Myron K. Brown, Creston (CA)

(73) Assignee: LaserSeed Inc., Calgary (CA)

( * ) Notice: Subject to any disclaimer, the term of this patent is extended or adjusted under 35 U.S.C. 154(b) by 559 days.

(21) Appl. No.: 15/452,102

(22) Filed: Mar. 7, 2017

(65) Prior Publication Data

US 2017/0275932 A1 Sep. 28, 2017

Related U.S. Application Data

(60) Provisional application No. 62/312,203, filed on Mar. 23, 2016.

(51) Int. Cl.

| | |
|---|---|
| ***E05B 65/08*** | (2006.01) |
| ***E05C 17/04*** | (2006.01) |
| ***E05C 17/30*** | (2006.01) |

(52) U.S. Cl.

CPC ..... *E05C 17/047* (2013.01); *E05B 65/0888* (2013.01); *E05C 17/30* (2013.01)

(58) Field of Classification Search

CPC ..... E05C 17/047; E05C 17/30; E05B 65/0888
See application file for complete search history.

(56) References Cited

U.S. PATENT DOCUMENTS

| | | | |
|---|---|---|---|
| 2,698,656 | A | 1/1955 | Levey |
| 3,224,048 | A | 12/1965 | Sullivan |
| 3,816,967 | A | 6/1974 | Littrell |

(Continued)

FOREIGN PATENT DOCUMENTS

| | | |
|---|---|---|
| CA | 1146016 | 5/1983 |
| CA | 1270152 | 6/1990 |

(Continued)

OTHER PUBLICATIONS

Wedgit Door and Window Lock, "About the Wedgit Window and Door Lock", copyright 2011-2015, last updated Nov. 29, 2017, downloaded from http://www.slidingpatiodoorlock.com on Jan. 7, 2019.

(Continued)

*Primary Examiner* — Kristina R Fulton

*Assistant Examiner* — Thomas L Neubauer

(74) *Attorney, Agent, or Firm* — ATMAC Patent Services Ltd.; Andrew T. MacMillan

(57) ABSTRACT

A window security device has a support rod capable of securely contacting an upper window frame and a lower window frame. The device has two horizontal arms extending from away from the support rod terminating in thin blades capable of sliding between a first stationary window and a second sliding window sash. The device prevents unwanted tampering with the device by children located on the inside of the window as well as burglars located on the exterior of the window and to be easily removed in the event of a fire. The length of the device's blade can be adjusted allow a window to safely remain open a specified distance, and the device's arms can be adjusted to fit many different widths of windows. When the blades are disposed between the windows, the window is slid open and contacts the window stop, located at the end of the horizontal arms.

17 Claims, 7 Drawing Sheets

(56) References Cited

U.S. PATENT DOCUMENTS

| | | | | |
|---|---|---|---|---|
| 4,615,142 | A | 10/1986 | Reeves | |
| 4,669,934 | A * | 6/1987 | Wisecarver | B60P 7/15 292/259 R |
| 4,971,374 | A * | 11/1990 | Lovell | E05C 21/00 206/231 |
| 5,007,200 | A | 4/1991 | Londono | |
| 5,020,756 | A | 6/1991 | Bauer | |
| 6,474,021 | B2 * | 11/2002 | Homeyer | A47D 7/002 160/372 |
| 7,137,655 | B2 | 11/2006 | Quarberg | |
| 7,731,252 | B1 | 6/2010 | Stewart | |
| 2013/0269257 | A1 | 10/2013 | Grunbichler | |

FOREIGN PATENT DOCUMENTS

| | | | |
|---|---|---|---|
| CA | 2729677 | A1 | 6/2010 |
| EP | 0856634 | | 8/1998 |
| WO | 2004104354 | | 12/2004 |

OTHER PUBLICATIONS

Wedgit Door and Window Lock, "Wedgit door and window lock products", copyright 2011-2015, last updated Dec. 13, 2017, downloaded from http://www.slidingpatiodoorlock.com/sliding-patio-door-lock-products.htm on Jan. 7, 2019.

* cited by examiner

WINDOW SECURITY DEVICE

CROSS-REFERENCE TO RELATED APPLICATIONS

This application claims the benefit of priority of U.S. Provisional Application No. 62/312,203 filed Mar. 23, 2016, which is incorporated herein by reference.

BACKGROUND OF THE INVENTION (1) Field of the Invention

The present invention relates generally to window security devices, and more particularly, relating to a window security device for securing a partially open window against further opening.

(2) Description of the Related Art

Placing security devices on or within a window, or within a window frame, to prevent unauthorized access from the exterior of a window to the interior of the window, is well known in the art. These devices include vertical and horizontal bars that are permanently installed and extend across the window, covering either the interior or exterior of a window to prevent passage through the window. These devices further include security systems built into the window sash to increase the aesthetics of the system while still offering the requisite protection from intruders.

While these existing devices provide the security needed to prevent unwanted entrances through a window they have drawbacks. Initially, to install the devices that are permanently installed one must screw the device into the window sash, the window frame or even the wall. This leaves holes behind if the owner ever wishes to remove the device. Additionally, these devices are not aesthetically appeasing nor are they portable. Further, other designs only allow the window to be closed while the device is in place, which is not desirable in climates where users would like fresh air to come through the window.

Thus, there is a need for a new design of a window security device that is portable, does not damage the window or its frame, the sash, or the surrounding wall, and that provides the desired protection while allowing the window to be at least partially opened.

BRIEF SUMMARY OF THE INVENTION

In view of the foregoing disadvantages inherent in the known types of window security devices now present in the prior art, the present invention provides a new window security device construction with the purpose of overcoming the disadvantages of existing window security devices.

An object of the present invention is to provide a new window security device that is portable and capable of being used on many differently sized windows.

Another object of the present invention is to provide a window security device that is capable of securing a partially opened window from being opened further.

Another object of the present invention is to provide a new window security device that is easily removed in the event of a fire.

Another object of the present invention is to provide a window security device that prevents child tampering.

Another object of the invention is to provide a window security device that can be quickly removed from a window in an emergency to allow egress through the window.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof.

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION

With reference to FIGS. 1-11, there is representatively illustrated a new window security device 10 that is constructed in accordance with a first embodiment of the present invention.

Figure 1:
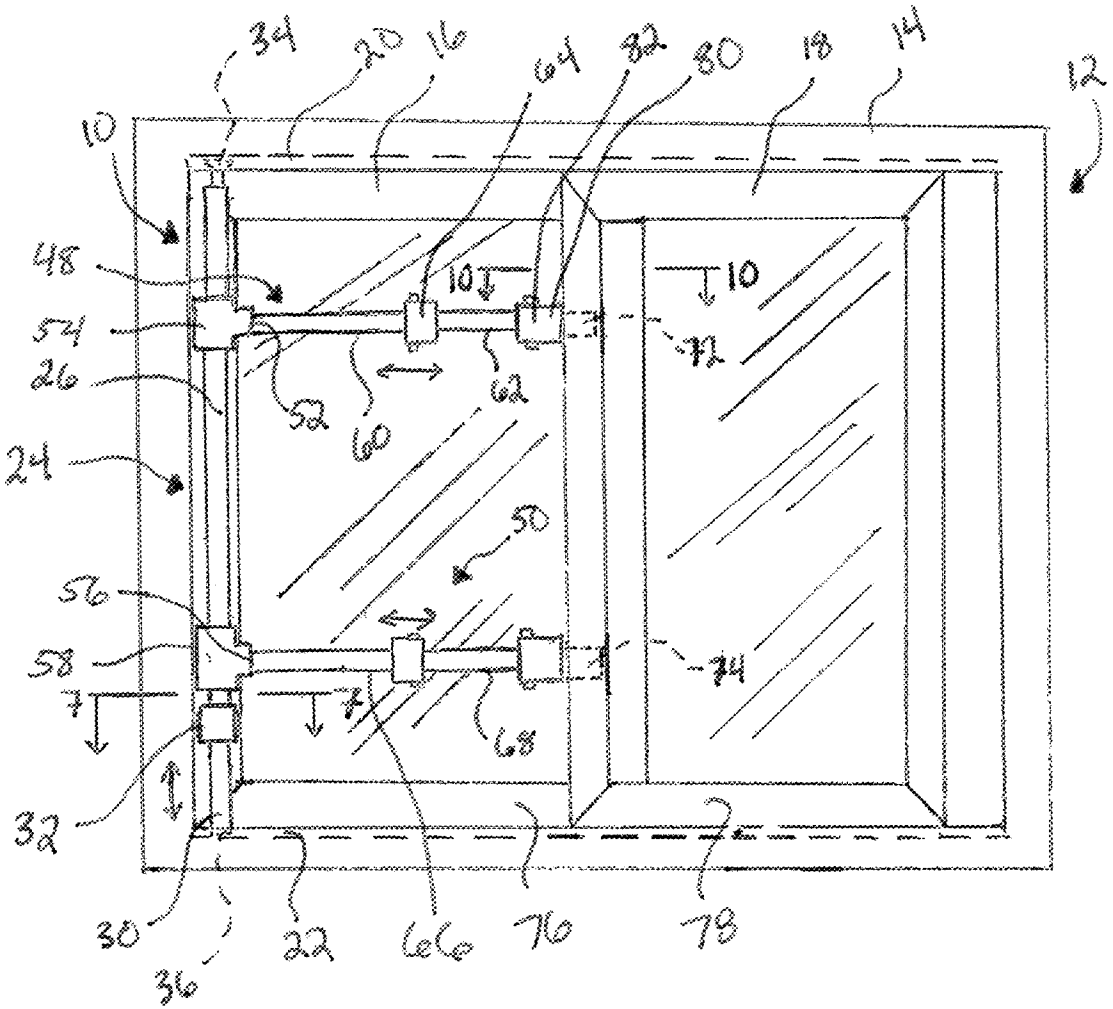
FIG. 1 is a diagrammatic front elevation view of a window security device constructed in accordance with the principles of an embodiment of the present invention, shown in-use with a conventional sliding window assembly and securing a partially open window from further opening.
Figure 2:
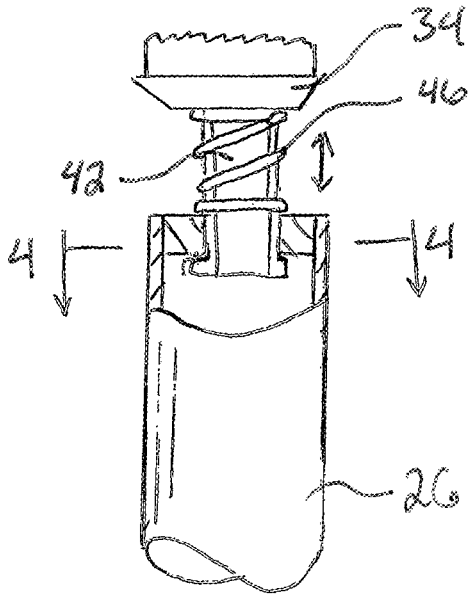
FIG. 2 is an enlarged partial elevation view of an end of a support member of the window security device of FIG. 1, showing a spring biased foot.
Figure 3:
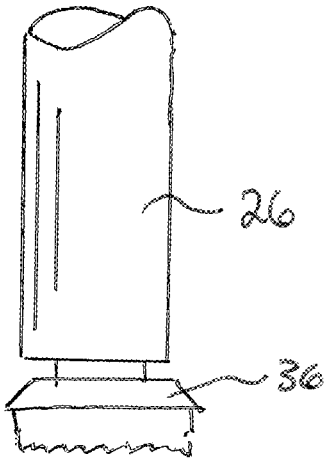
FIG. 3 is an enlarged partial elevation view of an opposite end of the support member of the window security device of FIG. 1, showing a fixed foot.

With initial reference to FIG. 1, the window security device 10 is shown in use with a conventional sliding window assembly 12. Representatively, the sliding window assembly 12 includes a window frame 14, and windows 16 and 18 mounted within upper and lower window channels 20 and 22. Window 16 has a window sash 76 and window 18 has a window sash 78, each supporting a respective window pane. As shown, the window security device 10 is mounted to the window assembly 12 and is suitable for securing a partially opened window 18 from opening further.

At this point, it should be noted that while the following discussion is made in reference to a window assembly having horizontally sliding windows, the window security device 10 can also be used with a window assembly having vertically sliding windows. Additionally, the principals of the window security device 10 can be adapted for use with sliding doors.

With further reference to FIGS. 2-11, the window security device 10 includes a support member 24 that is adjustable in length to extend between opposite sides of a window frame to which the window security device 10 is mounted. The support member 24 has an outer elongated tubular member 26 having a central passage 28 into which is telescoping received an inner tubular member 30. The tubular members 26 and 30 are longitudinally moved relative to one another to adjust the length of the support member 24.

A lever clamp 32 is attached to the end of tubular member 26 and operates to secure the tubular members 26 and 30 relative to one another. The particular structure of the level clamp 32 does not form part of this application and one of ordinary skill in the art is capable of selecting a suitable lever claim. Examples, of suitable lever clamps are described by U.S. Pat. Nos. 5,441,307; 5,775,352; 8,006,711 and 8,496,018, which are incorporated herein by reference in their entirety.

Figure 4:
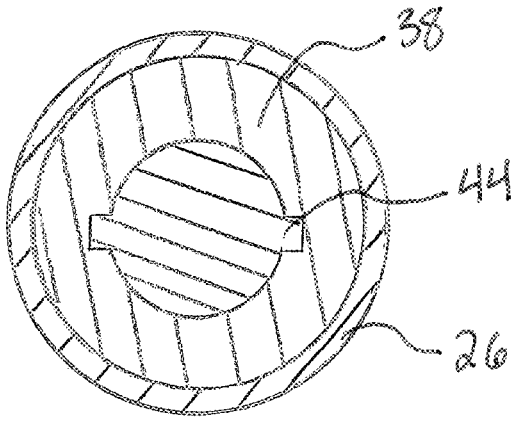
FIG. 4 is a cross-sectional view taken along the line 4-4 in FIG. 2.
Figure 5:
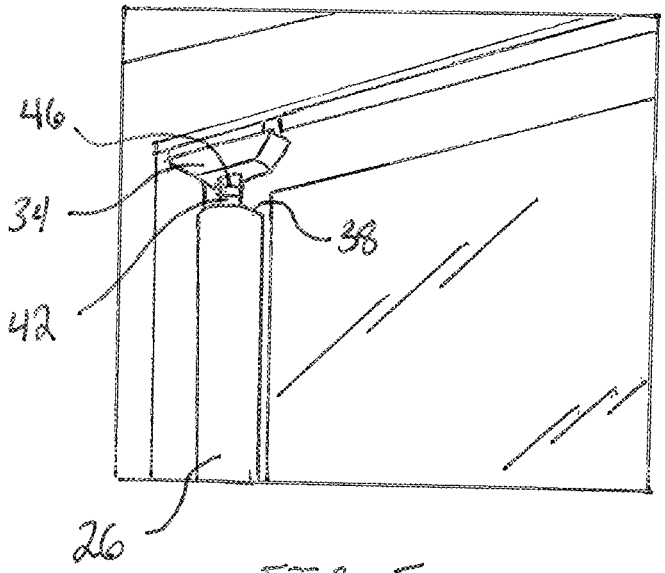
FIG. 5 is a partial perspective view of the support member and spring biased foot installed within a window channel of a window.
Figure 6:
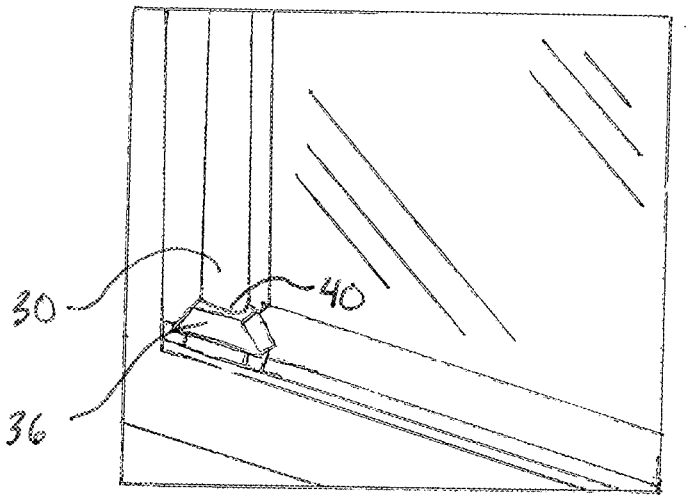
FIG. 6 is a partial perspective view of the support member and fixed foot installed within a window channel of a window.

A pair of rectangular feet 34 and 36 are attached to opposite ends 38 and 40, respectively, of the support member 24. Foot 36 is fixedly attached to end 40 so that is conjoined with end 40. Foot 34 is movably attached to end 38 so as to telescope in a longitudinal direction outwardly from end 38. More specifically, foot 34 includes a post 42 that extends through end 38 and is captively retained for telescopic movement relative to end 38 by flanged end 44. A coil spring 46 is disposed about the post 42 and between the foot 34 and the end 38. The coil spring 46 acts to urge the foot 34 in the outwardly direction. To prevent foot 34 from rotating relative to end 38, the post 42 is keyed with end 44, as best seen in FIG. 4.

The window security device 10 further includes first and second jam arms 48 and 50 that are attached to the support member 24 and extend outwardly therefrom in a direction generally perpendicular to the support member 24. The first jam arm 48 is pivotally attached at end 52 to the outer tubular member 26 of the support member 24 by collar 54 for rotation about the support member 24. The second jam arm 50 is fixedly attached at end 56 to the outer tubular member 26 of the support member 24 at a spaced distance from the first jam arm 48 by collar 58 for conjoined movement with the outer tubular member 26.

The first jam arm 48 is extendable in length, and similar to the support member 24 includes an outer tubular member 60 into which is telescoping received an inner tubular member 62. The tubular members 60 and 62 are longitudinally moved relative to one another to adjust the length of the first jam arm 48. A lever clamp 64, similar to lever clamp 32, is attached to the end of tubular member 60 opposite of the support member 24 and operates to secure the tubular members 60 and 62 relative to one another.

Similar to the first jam arm 48, the second jam arm 50 is extendable in length and includes an outer tubular member 66 into which is telescoping received an inner tubular member 68. The tubular members 66 and 68 are longitudinally moved relative to one another to adjust the length of the second jam arm 50. A lever clamp 70, similar to lever clamp 32, is attached to the end of tubular member 66 opposite of the support member 24 and operates to secure the tubular members 66 and 68 relative to one another.

Figure 10:
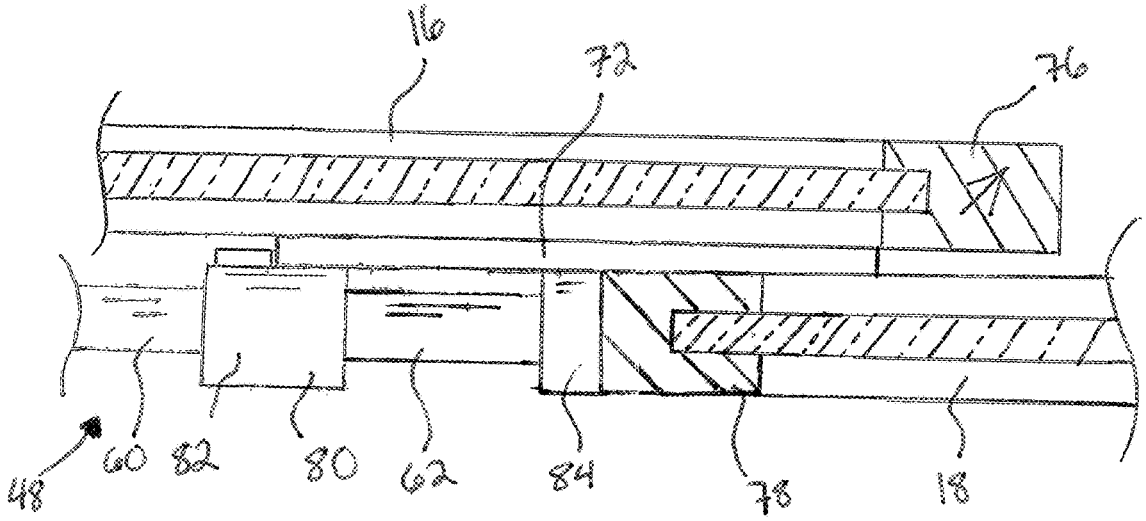
FIG. 10 is a cross-sectional view of a jam arm of the window security device taken along line 10-10 in FIG. 1, shown in use securing a partially opened window.
Figure 11:
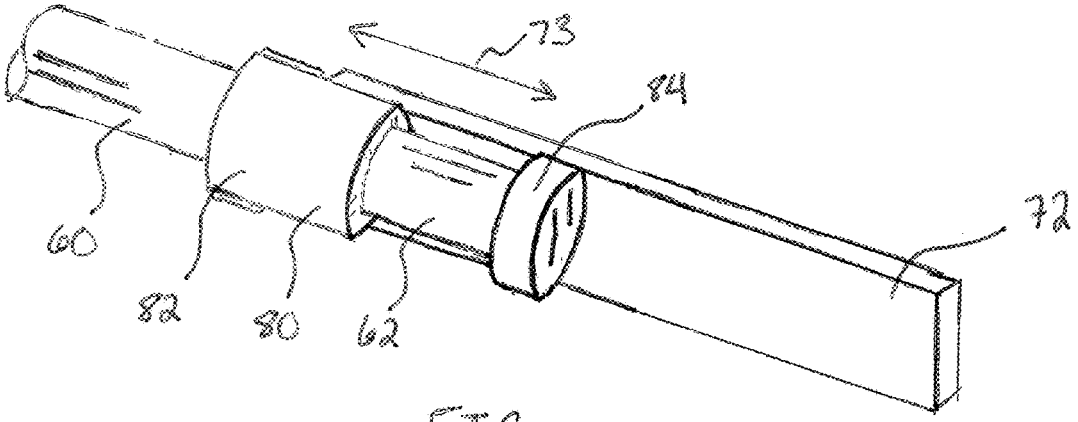
FIG. 11 is a partial perspective view of the a jam arm of the window security device, showing an adjustable sash blade.

The window security device 10 further includes sash blades 72 and 74 that are slidably mounted to the jam arms 48 and 50, respectively. As shown in FIGS. 10 and 11, sash blade 72 has a relatively thin, elongated rectangular construction so as to fit in the space between facing sides of window sashes 76 and 78. Sash blade 72 is slidably mounted to the inner tubular member 62 of jam arm 48 by collar 80 for longitudinal movement in a direction toward and away from end 52 of the first jam arm 48. Collar 80 includes a lever clamp 82, similar to lever clamp 32, and operates to secure the position of the sash blade 72 relative to end 84 of the jam arm 48. Since sash blade 74 has a similar construction to sash blade 72, a separate discussion of sash blade 74 is not required for understanding of its construction and operation.

In use, it can now be understood the window security device 10 is installed on a window to by placing support member 24 within sliding window assembly 12. The rectangular foot 34 is positioned within window channel 20 and the lever clamp 32 is operated to allow the inner tubular member 30 to be adjusted so as to allow rectangular foot 36 to be positioned within window channel 22. When the support member 24 is securely disposed between the window tracts 20 and 22 of the window frame 14, the lever clamp 32 is closed, securing the inner tubular member 30 to the outer elongated tubular member 26.

Figure 7:
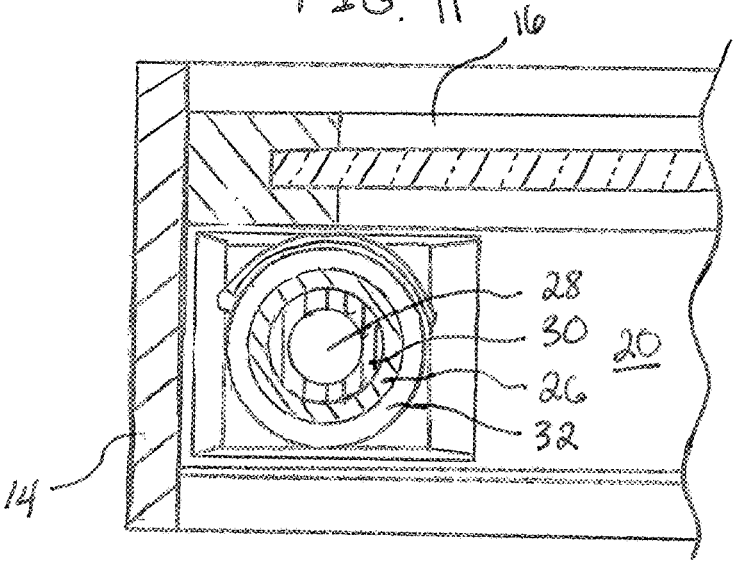
FIG. 7 is a partial cross-sectional view taken along line 7-7 in FIG. 1.
Figure 8:
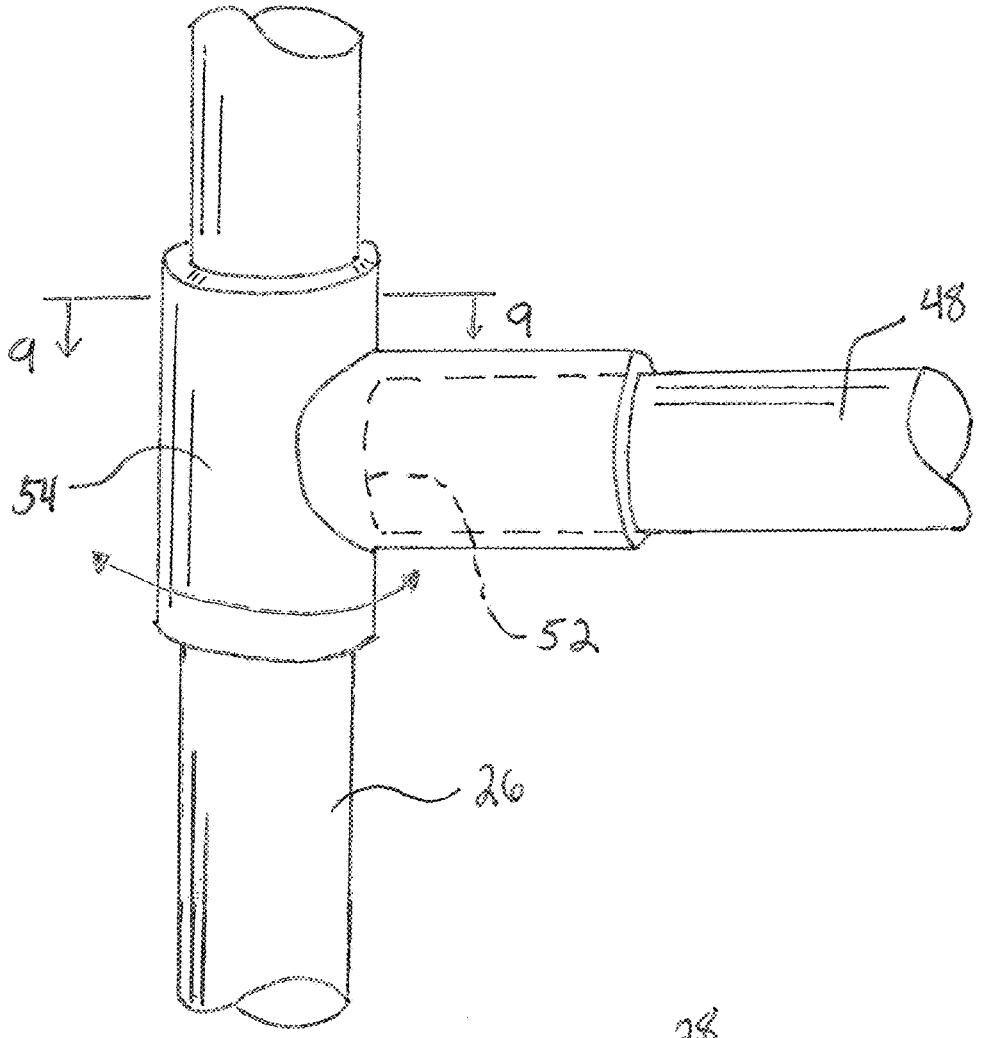
FIG. 8 is an enlarged partial perspective view of the support member of the window security device, showing a pivotal connection between a jam arm and the support member.
Figure 9:
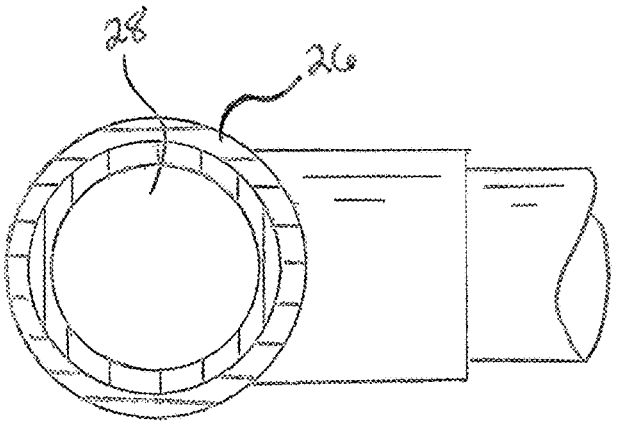
FIG. 9 is a cross-sectional view of the support member taken along the line 9-9 in FIG. 8.

It is important to note, when the support member 24 is installed as described, the lever clamp 32 is positioned such that the lever of the clamp is facing the window 16, as shown in FIG. 7, in order to prevent someone from tampering with the window security device 10.

To adjust the distance the sliding window 18 is to remain open while the window security device 10 is in use, the length of sash blades 72 and 74 must be adjusted. To adjust the length of sash blade 72 of first jam arm 48 lever clamp 82 is operated to slide collar 80 along the inner tubular member 62 until the desired distance 73 between the arm end 84 and the end of sash blade 72 is achieved. The desired distance 73 is equal to the distance sliding window 18 can safely be opened without fear of unwanted intrusion. Since sash blade 74 is adjusted similar to that of sash blade 72, a separate discussion of adjusting the length of sash blade 74 is not required for understanding the operation of adjusting sash blade 74.

Depending on the distance between support member 24 and window sash 76, the first and second jam arms 48 and 50 must be adjusted to ensure the window security device 10 is securely installed. The window security device 10 is properly installed when the sash blades 72 and 74 extend to and abut window sash 76. The sash blades 72 and 74 should not extend beyond window sash 76. Because the first jam arm 48 and second jam arm 50 are similarly adjusted, a discussion of the first jam arm 48 is only required.

To ensure sash blade 72 is properly located along stationary window 16, lever clamp 64 is operated to allow the inner tubular member 62 to extend away from the support member 24 until sash blade 72 abuts window sash 76. Lever clamp 64 is then operated to lock the inner tubular member 62 relative to the outer tubular member 60, thereby fixing the length of the first jam arm 48. When installed, it is important to note that lever clamps 64 and 82 are disposed between the first jam arm 48 and window 16 to prevent tampering.

An important feature of window security device 10 is the ability for window security device 10 to quickly be removed in case of an emergency, such as a fire, that requires a quick-exit through a window that equipped with the window security device 10. During an emergency, one simply ensures sliding window 18 is in the closed position. The first jam arm 48 is rotated about support member 24. The support member 24 is then tilted away from the window frame 14, toward the sliding window 18, thereby removing the rectangular foot 34 from the window tract 20, which allows the window security device 10 to be removed from the sliding window assembly 12. Thereby allowing the sliding window 18 to open in its entirety and a safe passage through the window.

Figure 12:
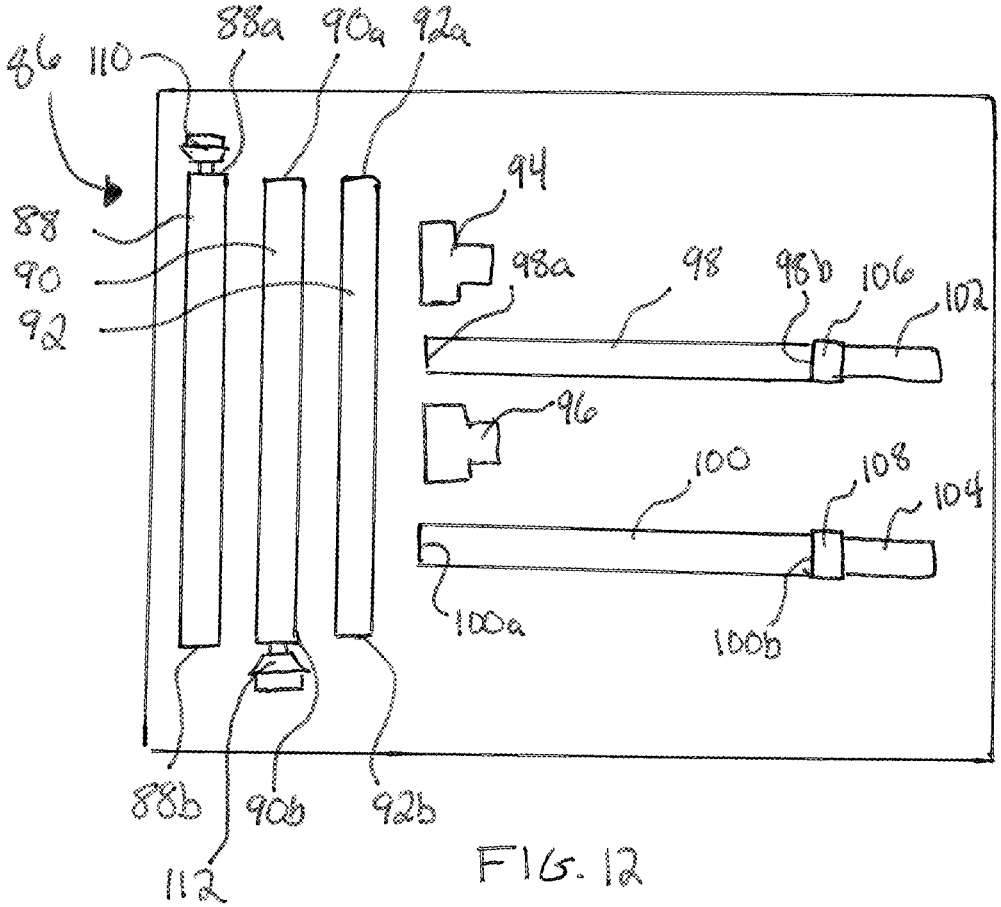
FIG. 12 is a diagrammatic view of a window security device kit constructed in accordance with the principles of an embodiment of the present invention.
Figure 13:
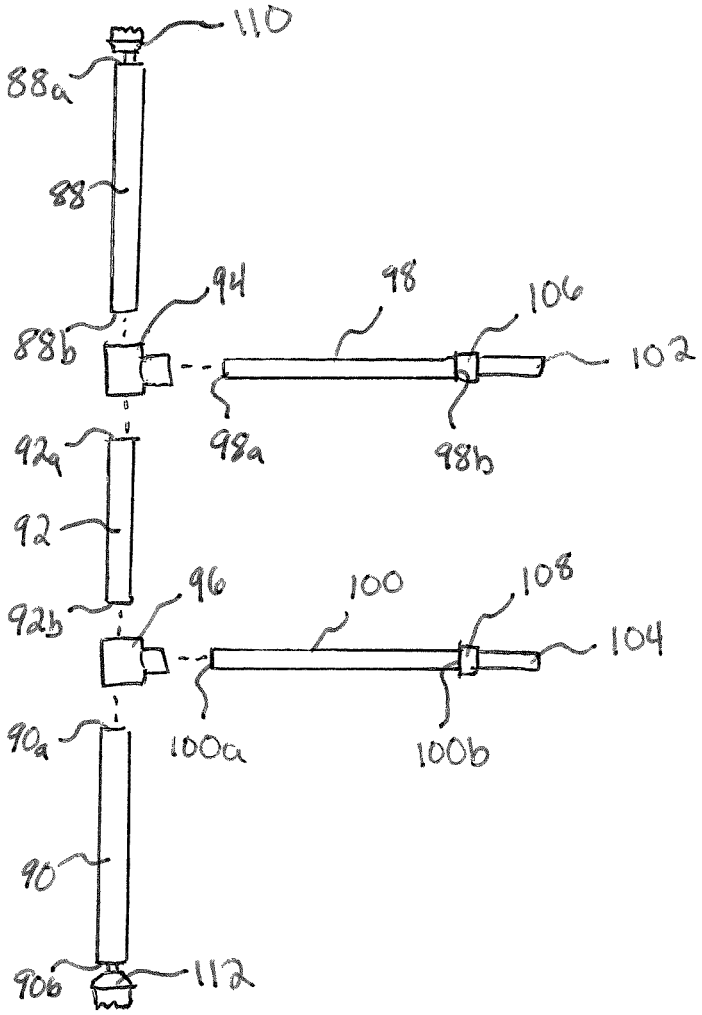
FIG. 13 is an exploded view of a window security device constructed by using the window security device kit.

Referring now to FIGS. 12 and 13, there is shown therein a window security device kit 86 in accordance with an embodiment of the present invention. The kit includes 86 a first, second, and third pipe section 88, 90, and 92. Each pipe section having respective first and second ends 88*a*, 88*b*, 90*a*, 90*b*, 92*a*, 92*b*. The first and second pipe sections each having a rectangular foot 110 and 112 fixedly attached to the respective first end 88*a* of first pipe section 88 and to the second end 90*b* of the second pipe section 90. The kit 86 further includes a two pipe tees 94 and 96 and two tubular arm sections 98 and 100 each having a sash blade 102 and 104 attached to the arm section 98 and 100 by a slip-on coupling 106 and 108.

When assembled, pipe tee 94 receives and connects the second end 88*b* of the first pipe section 88 to the first end 92*a* of the third pipe section; and pipe tee 96 receives and connects the second end 92*b* of the third pipe section 92 to the first end 90*a* of the second pipe section 90. Further, tubular arm section 98 and 100 are perpendicularly connected to pipe tee 94 and 96 at ends 98*a* and 100*a*, respectively.

The distance between rectangular foot 110 and the rectangular foot 112 should be equal to that of opposing sides of window frame 14. To achieve the correct distance, pipe sections 88, 90, or 92 can be trimmed at ends 88*b*, 92*a*, 92*b*, or 90*a*. Additionally, when properly sized, the sash blades 102 and 104 of the assembled window security device kit 86 should abut the sash of the stationary window, opposite to that of pipe tee 94 and 96. To ensure the assembled kit 86 is sized properly, tubular arm sections 98 and 100 can be trimmed at ends 98*a* and 100*a*.

In an exemplary embodiment, a window security device has a support rod capable of securely contacting an upper window frame and a lower window frame. The device has two horizontal arms extending from away from the support rod terminating in thin blades capable of sliding between a first stationary window and a second sliding window sash. The device prevents unwanted tampering with the device by children located on the inside of the window as well as burglars located on the exterior of the window and to be easily removed in the event of a fire. The length of the device's blade can be adjusted allow a window to safely remain open a specified distance, and the device's arms can be adjusted to fit many different widths of windows. When the blades are disposed between the windows, the window is slid open and contacts the window stop, located at the end of the horizontal arms.

Although the invention has been described in connection with preferred embodiments, it should be understood that various modifications, additions and alterations may be made to the invention by one skilled in the art without departing from the spirit and scope of the invention.

Functions of single modules may be separated into multiple units, or the functions of multiple modules may be combined into a single unit. All combinations and permutations of the above described features and embodiments may be utilized in conjunction with the invention.

What is claimed is:

1. A window security device comprising:

an outer elongated tubular member;

an inner elongated tubular member telescopically received within said outer elongated tubular member;

a lever clamp disposed at an end of said outer elongated tubular member;

a first jam arm rotatably attached to said outer elongated tubular member, wherein said first jam arm and said outer elongated tubular member are perpendicular;

a second jam arm fixedly attached to said outer elongated tubular member, wherein said second jam arm and said outer elongated tubular member are perpendicular;

said first jam arm having a first arm inner elongated tubular member and a first arm outer elongated tubular member, wherein said first arm inner elongated tubular member is slidably received by said first arm outer elongated tubular member;

said second jam arm having a second arm inner elongated tubular member and a second arm outer elongated tubular member, wherein said second arm inner elongated tubular member is slidably received by said second arm outer elongated tubular member;

a first adjustable sash blade and a second adjustable sash blade, each having a thin, elongated, rectangular structure;

a first collar and a second collar fixedly attached to the first sash blade and second sash blade respectively, the first collar and the second collar being slidably disposed about said first arm inner elongated tubular member and said second arm inner elongated tubular member respectively;

a first clamp and a second clamp attached to the first collar and second collar respectively, the first clamp and second clamp being respectively operable to fix positions of the first collar and second collar along the first jam arm and second jam arm respectively;

wherein, positions of the first and second adjustable sash blades are adjusted by sliding the first and second collars along the first and second jam arms respectively such that a length of each of the first and second adjustable sash blades extends beyond unattached ends of the first jam arm and the second jam arm respectively.

2. The window security device of claim 1 further comprising:

a first rectangular foot;

a foot post attached to said first rectangular foot and telescopically received by said outer elongated tubular member;

a spring disposed along said foot post between the end of said outer elongated tubular member and said first rectangular foot; and said foot post having a flanged end, opposite of said first rectangular foot, wherein said flanged end prevents axial rotation of said first rectangular foot.

3. The window security device of claim 1, further comprising:

a second rectangular foot fixedly attached to the inner elongated tubular member.

4. A window security device kit, comprising:

a first pipe section having a first end and a second end, wherein a first rectangular foot is fixedly disposed at said first end;

a second pipe section having a first end and a second end;

a third pipe section having a first end and a second end, wherein a second rectangular foot is fixedly disposed at said second end;

a first sash blade and a second sash blade, each having a thin, elongated, rectangular structure;

a first tubular arm section having a first end and a second end, wherein said first sash blade attached to a first slip-on coupling is fixedly attached to said second end;

a second tubular arm section having a first end and a second end, wherein s-said second sash blade attached to a second slip-on coupling is fixedly attached to said second end;

a first pipe tee and a second pipe tee, wherein said first pipe section is attached to said third pipe section by said first pipe tee, and said second pipe section is attached to said third pipe section by said second pipe tee; and said first tubular arm is attached to said first pipe tee and said second pipe tee is attached to said second pipe tee.

5. The window security device kit of claim 4, wherein the length of said first pipe section, said second pipe section, and said third pipe section is adjusted by trimming a tubular portion from said first pipe section, said second pipe section, and said third pipe section.

6. The window security device kit of claim 4, wherein the length of said first tubular arm section and said second tubular arm section is adjusted by trimming a tubular portion from said first tubular arm section and said second tubular arm section.

7. A window security device comprising:

a first jam arm for being positioned between a fixed window frame and a moveable window sash;

the first jam arm having an inner elongated tubular member and an outer elongated tubular member, wherein the inner elongated tubular member is slidably received by the outer elongated tubular member;

one or more clamps on the first jam arm for selectively preventing the inner elongated tubular member of the first jam arm from sliding past a particular position when being received by the outer elongated tubular member;

a support member attached to a first end of the first jam arm for securing the first end of the first jam arm in position relative to the fixed window frame;

a collar mounted on the first jam arm towards a second end of the first jam arm, the second end of the first jam arm being toward the moveable window sash; and an adjustable sash blade with a first blade end that is attached to the collar, the adjustable sash blade having a thin, elongated, rectangular structure with a thinness that allows the adjustable sash blade to fit in a space between the moveable window sash and a surface adjacent the moveable window sash;

wherein a position of the adjustable sash blade is adjusted by sliding the collar along the first jam arm such that a length of the adjustable sash blade extends beyond the second end of the first jam arm resulting in a second blade end of the adjustable sash blade being positioned adjacent the moveable window sash;

the first jam arm allows the moveable window sash to be opened only a predetermined distance toward the fixed window frame as determined according to the particular position set by the one or more clamps;

the second end of the first jam arm obstructs further opening of the moveable window sash beyond the predetermined distance; and the adjustable sash blade when extended into the space between the moveable window sash and the surface adjacent the moveable window sash prevents removal of the first jam arm from between the fixed window frame and the moveable window sash.

8. The window security device of claim 7, further comprising:

the support member including an outer elongated tubular member and an inner elongated tubular member telescopically received within the outer elongated tubular member;

a lever clamp disposed at the end of the outer elongated tubular member of the support member;

the first jam arm rotatably attached to the outer elongated tubular member at the first end of the first jam arm, wherein the first jam arm and the outer elongated tubular member are perpendicular.

9. The window security device of claim 8, wherein the collar and the one or more clamps are slidably disposed about the inner tubular member of the first jam arm.

10. The window security device of claim 8, further comprising:

a second jam arm fixedly attached to the outer elongated tubular member, wherein the second jam arm and the outer elongated tubular member are perpendicular;

the second jam arm having an inner elongated tubular member and an outer elongated tubular member, wherein the inner elongated tubular member is slidably received by the outer elongated tubular member of the second jam arm.

11. The window security device of claim 8, further comprising:

a first rectangular foot;

a foot post attached to the first rectangular foot and telescopically received by the outer elongated tubular member of the support member;

a spring disposed along the foot post between the end of the outer elongated tubular member of the support member and the first rectangular foot; and the foot post having a flanged end, opposite of the first rectangular foot, wherein the flanged end prevents axial rotation of the first rectangular foot.

12. The window security device of claim 11, further comprising a second rectangular foot fixedly attached to the inner elongated tubular member of the support member.

13. The window security device of claim 7, wherein the surface adjacent the moveable window sash is a stationary window on the fixed window frame, such that part of the length of the adjustable sash blade fits in the space between the stationary window of the fixed window frame and the moveable window sash.

14. The window security device of claim 7, wherein the position of the adjustable sash blade is further adjusted such that the length of the adjustable sash blade that extends beyond the second end of the first jam arm is equal to the predetermined distance that the moveable window sash can be opened.

15. The window security device of claim 7, wherein the position of the adjustable sash blade is further adjusted, and the particular position is further set by the one or more clamps, such that the first jam arm can be removed from between the fixed window frame and the moveable window sash only when the moveable window sash is closed.

16. The window security device of claim 7, wherein the position of the adjustable sash blade is further adjusted such that no part of the adjustable sash blade extends beyond an edge of the moveable window sash that is towards the fixed window frame thereby ensuring that the adjustable sash blade prevents removal of the first jam arm from between the fixed window frame and the moveable window sash only when the moveable window sash has been opened.

17. The window security device of claim 7, further comprising a clamp attached to the collar that has the first blade end of the adjustable sash blade attached, the clamp being operable to secure the position of the adjustable sash blade and collar relative to the second end of the first jam arm.

* * * * *